US006719641B2

(12) United States Patent
Dabbs et al.

(10) Patent No.: US 6,719,641 B2
(45) Date of Patent: Apr. 13, 2004

(54) GOLF IRON HAVING A CUSTOMIZABLE WEIGHTING FEATURE

(75) Inventors: Tony R. Dabbs, Palm Beach Gardens, FL (US); Dabbs C. Long, Carlsbad, CA (US)

(73) Assignee: Nicklaus Golf Equipment Company, West Palm Beach, FL (US)

( * ) Notice: Subject to any disclaimer, the term of this patent is extended or adjusted under 35 U.S.C. 154(b) by 0 days.

(21) Appl. No.: 10/133,148

(22) Filed: Apr. 26, 2002

(65) Prior Publication Data

US 2003/0203764 A1 Oct. 30, 2003

(51) Int. Cl.[7] ..... A63B 53/04
(52) U.S. Cl. ..... 473/291; 473/350
(58) Field of Search ..... 473/334, 335, 473/336, 290, 291, 350

(56) References Cited

U.S. PATENT DOCUMENTS

| | | | | | |
|---|---|---|---|---|---|
| 2,846,228 | A | * | 8/1958 | Reach | 473/332 |
| 3,059,926 | A | * | 10/1962 | Johnstone | 473/291 |
| 5,290,036 | A | * | 3/1994 | Fenton et al. | 473/332 |
| 5,316,298 | A | | 5/1994 | Hutin et al. | |
| 5,409,229 | A | * | 4/1995 | Schmidt et al. | 473/332 |
| 5,472,203 | A | | 12/1995 | Schmidt et al. | |
| 5,524,880 | A | * | 6/1996 | Kobayashi | 473/291 |
| 5,658,208 | A | | 8/1997 | Shimasaki | |
| 5,669,826 | A | * | 9/1997 | Chang et al. | 473/332 |
| 5,704,849 | A | | 1/1998 | Schmidt et al. | |
| 5,707,302 | A | | 1/1998 | Leon et al. | |
| 5,749,795 | A | | 5/1998 | Schmidt et al. | |
| 5,755,624 | A | * | 5/1998 | Helmstetter | 473/291 |
| 5,807,191 | A | * | 9/1998 | Nakahara | 473/350 |
| 6,045,455 | A | | 4/2000 | Kosmatka et al. | |
| 6,206,790 | B1 | | 3/2001 | Kubica et al. | |
| 6,210,290 | B1 | * | 4/2001 | Erickson et al. | 473/345 |
| 6,290,607 | B1 | * | 9/2001 | Gilbert et al. | 473/291 |
| 6,454,665 | B2 | * | 9/2002 | Antonious | 473/346 |
| 6,554,719 | B2 | * | 4/2003 | Peters et al. | 473/291 |

FOREIGN PATENT DOCUMENTS

| | | |
|---|---|---|
| WO | 00/76595 | 12/2000 |

* cited by examiner

*Primary Examiner*—Stephen Blau
(74) *Attorney, Agent, or Firm*—Fay, Sharpe, Fagan, Minnich & McKee, LLP

(57) ABSTRACT

An iron golf club head includes a heel portion, a toe portion, a sole portion, a top portion, a hosel portion, and a striking face having a front surface and a back surface. A peripheral mass is disposed on the back surface, which defines a first cavity. A cantilevered mass extends from the sole portion toward the top portion within the first cavity. The cantilevered mass includes a rear surface, which defines a second cavity in which a weight medallion is disposed. The weight medallion includes a high-density portion and a low-density portion, providing a customizable weighting device for controlling right or left shot tendencies from which golfers suffer. By positioning the high-density portion of the weighted medallion near the heel or toe, depending on the golfer's shot tendency, longer and straighter shots are achievable.

20 Claims, 6 Drawing Sheets

GOLF IRON HAVING A CUSTOMIZABLE WEIGHTING FEATURE

BACKGROUND OF THE INVENTION

The present invention relates to the art of golf clubs. It finds particular application in conjunction with an iron golf club head having a customizable weighting feature to provide better performance, and will be described with particular reference thereto. It is to be appreciated, however, that the present invention is amenable to other like applications.

Golf irons include a club head joined to a hosel and a shaft with the shaft being attached to the head by fitting the shaft into a bore formed within the hosel. The hosel is typically attached to and formed integrally with the head of an iron. Irons are generally classified by loft angle. Irons having low loft angles, e.g., 17°–25°, are classified as long irons, while irons having large loft angles, e.g., 40°–60°, are classified as short irons. Typically, irons are numbered from long to short, i.e., 1, 2, 3, 4, 5, 6, 7, 8, 9, PW (pitching wedge), SW (sand wedge), LW (lob wedge).

Golf irons are said to be either a traditional design wherein the iron is forged and has a generally continuous back portion or a second type of design known as cavity backed. In the cavity backed design, the back portion of the club head includes a substantial depression or cavity, which has the effect of providing perimeter weighting for the club head. Traditionally, cavity backed clubs, which include perimeter weighting, provide a larger "sweet spot" or striking area, such that a ball need not be struck precisely with the center of the striking face of the club to produce an acceptable golf shot.

The location and distribution of weight within a golf iron is an important factor in its performance. In particular, weight placement at the bottom of the golf club head provides a lower center of gravity, which assists in propelling a golf ball into the air during impact. In addition, weight concentrated at the toe and heel of the club head provides a resistance to twisting, or high moment of inertia, during golf ball impact.

While a low center of gravity and high moment of inertia are important performance variables that affect the playability and feel of a golf club, it is well known that average golfers suffer from a variety of swing inconsistencies, which cause undesirable golf shots. Some golfers have a tendency to push or fade golf shots, while other golfers have a tendency to pull or draw golf shots. In addition, many golfers have a tendency to push or fade long irons, hit middle irons straight, and pull short irons. Therefore, a need exists for a golf iron set having a customizable weighting feature to accommodate the variety of shot inconsistencies in the average golfer.

The present invention contemplates a new and improved golf iron, which overcomes the above-referenced problems and others.

SUMMARY OF THE INVENTION

In accordance with one aspect of the present invention, an iron golf club head includes a heel portion, a toe portion, a sole portion, a top portion, a hosel portion, and a striking face having a front surface and a back surface. A peripheral mass is disposed on the back surface, which defines a first cavity. A first weight member extends from the sole portion toward the top portion within the first cavity. The first weight member includes a rear surface, which defines a second cavity. A weight medallion is disposed within the second cavity.

In accordance with a more limited aspect of the present invention, at least a portion of the first weight member is spaced apart from the back surface.

In accordance with a more limited aspect of the present invention, the weight medallion has a density of at least 1.0 g/cm$^3$ and includes a high-density portion disposed adjacent the heel portion and a low-density portion disposed adjacent the toe portion.

In accordance with a more limited aspect of the present invention, the high-density portion is comprised of tungsten.

In accordance with a more limited aspect of the present invention, the high-density portion comprises approximately 90% of a total mass of the weight medallion.

In accordance with a more limited aspect of the present invention, the weight medallion includes a high-density portion disposed adjacent the toe portion and a low-density portion disposed adjacent the heel portion.

In accordance with another aspect of the present invention, a golf iron set includes a plurality of long irons, middle irons, and short irons. Each of the irons has a club head including a heel portion, a toe portion, a sole portion, a top portion, a hosel portion, and a striking face having front and back surfaces. A peripheral mass is disposed on the back surface, which defines a first cavity. A cantilevered mass extends from the sole portion toward the top portion within the first cavity. The cantilevered mass includes a rear surface which defines a second cavity. A weight medallion is disposed within the second cavity.

In accordance with a more limited aspect of the present invention, in the long irons, the cantilevered mass has a height $H_1$. The weight medallion includes a high-density portion disposed toward the heel portion and a low-density portion disposed toward the toe portion.

In accordance with a more limited aspect of the present invention, in the middle irons, the cantilevered mass has a height $H_2$, where $H_2>H_1$. In addition, the weight medallion includes two halves of equal density.

In accordance with a more limited aspect of the present invention, in the short irons, the cantilevered mass has a height $H_3$ where $H_3>H_2$. In addition, the weight medallion includes a high-density portion disposed toward the toe portion and a low-density portion disposed toward the heel portion.

In accordance with another aspect of the present invention, a golf iron, having a center of gravity, includes a heel portion, a toe portion, a sole portion, a top portion, a hosel portion, and a striking face having a front surface and a back surface. A peripheral mass is disposed on the back surface, which defines a first cavity. A cantilevered mass extends along a first direction from the sole portion toward the top portion within the first cavity. The cantilevered mass includes a rear surface, which defines a second cavity, and a height selected from one of $H_1$, $H_2$, and $H_3$, where $H_3>H_2>H_1$. The selected height determines the center of gravity along the first direction. The golf iron includes means for adjusting the center of gravity along a second direction, which is perpendicular to the first direction.

In accordance with a more limited aspect of the present invention, the means for adjusting the center of gravity along the second direction includes a horizontally elongated, bi-material weight member, which is disposed within the second cavity. The weight member includes a first semi-elongate portion, which is disposed adjacent the toe portion and a second semi-elongate portion, which is disposed adjacent the heel portion. The first semi-elongate portion has a substantially greater mass than the second semi-elongate portion.

In accordance with another aspect of the present invention, a method of making a golf club head includes forming a club head having a striking face, a top portion, a bottom portion, a toe portion, and a heel portion. A peripheral mass is formed on the rear surface of the striking face, defining a rear cavity. A cantilevered mass is formed, which extends from the bottom portion toward the top portion within the rear cavity. The cantilevered mass includes a rear surface, which defines a weight insert pocket. A bi-material weight medallion is formed out of a high-density material and a low-density material. The bi-material weight medallion is secured within the weight insert pocket.

In accordance with a more limited aspect of the present invention, the step of forming the bi-material weight medallion includes adhesively securing an elliptical decorative medallion plate to a semi-elliptical tungsten member and a semi-elliptical foam member.

In accordance with a more limited aspect of the present invention, the step of forming a bi-material weight medallion includes adhesively securing an elliptical decorative medallion plate to a semi-elliptical tungsten member and a semi-elliptical aluminum member.

In accordance with a more limited aspect of the present invention, the step of forming a cantilevered mass includes selecting a desired vertical center of gravity and forming the cantilevered mass having a height selected from one of $H_1$, $H_2$, and $H_3$, where $H_3>H_2>H_1$. The selected height of the cantilevered mass determines the vertical center of gravity.

In accordance with a more limited aspect of the present invention, the step of securing the bi-material weight medallion includes selecting a desired horizontal center of gravity from one of a toe-biased horizontal center of gravity and a heel-biased horizontal center of gravity. In response to selecting a toe-biased horizontal center of gravity, the bi-material weight medallion is secured within the weight insert pocket such that the high-density portion is disposed adjacent the toe. In response to selecting a heel-biased horizontal center of gravity, the bi-material weight medallion is secured within the weight insert pocket such that the high-density portion is disposed adjacent the heel.

In accordance with another aspect of the present invention, a golf club fitting system includes a plurality of irons each including a striking face, a heel portion, a toe portion, a sole portion, a top portion, and a peripheral mass on a back surface of the striking face, which defines a rear cavity. The cantilevered mass extends from the sole portion toward the top portion within the rear cavity. The cantilevered mass defines a weight insert pocket adapted to receive a weight medallion. In this system, a method of custom fitting a golfer with appropriate golf clubs includes assessing a shot tendency of the golfer for each of long irons, middle irons, and short irons. In response to the assessing step, for each golf club, an iron is selected, which has one of a toe-biased weight medallion, a center-biased weight medallion, or a heel-biased weight medallion within the weight insert pocket.

In accordance with a more limited aspect of the present invention, if the golfer's shot tendency is a fade/push, an iron having a heel-biased weight medallion within the weight insert pocket is selected. If the golfer's shot tendency is a draw/pull, an iron having a toe-biased weight medallion within the weight insert pocket is selected. If the golfer's shot tendency is straight, and iron having a center-biased weight medallion within the weight insert pocket is selected.

One advantage of the present invention resides in an optimized weight distribution.

Another advantage of the present invention resides in a weight medallion customizable to offset either pushed or pulled golf shots.

Another advantage of the present invention is resides in a variable-height cantilevered mass for adjusting a vertical center of gravity.

Yet another advantage of the present invention resides in a bi-material weight medallion for adjusting a horizontal center of gravity.

Still other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
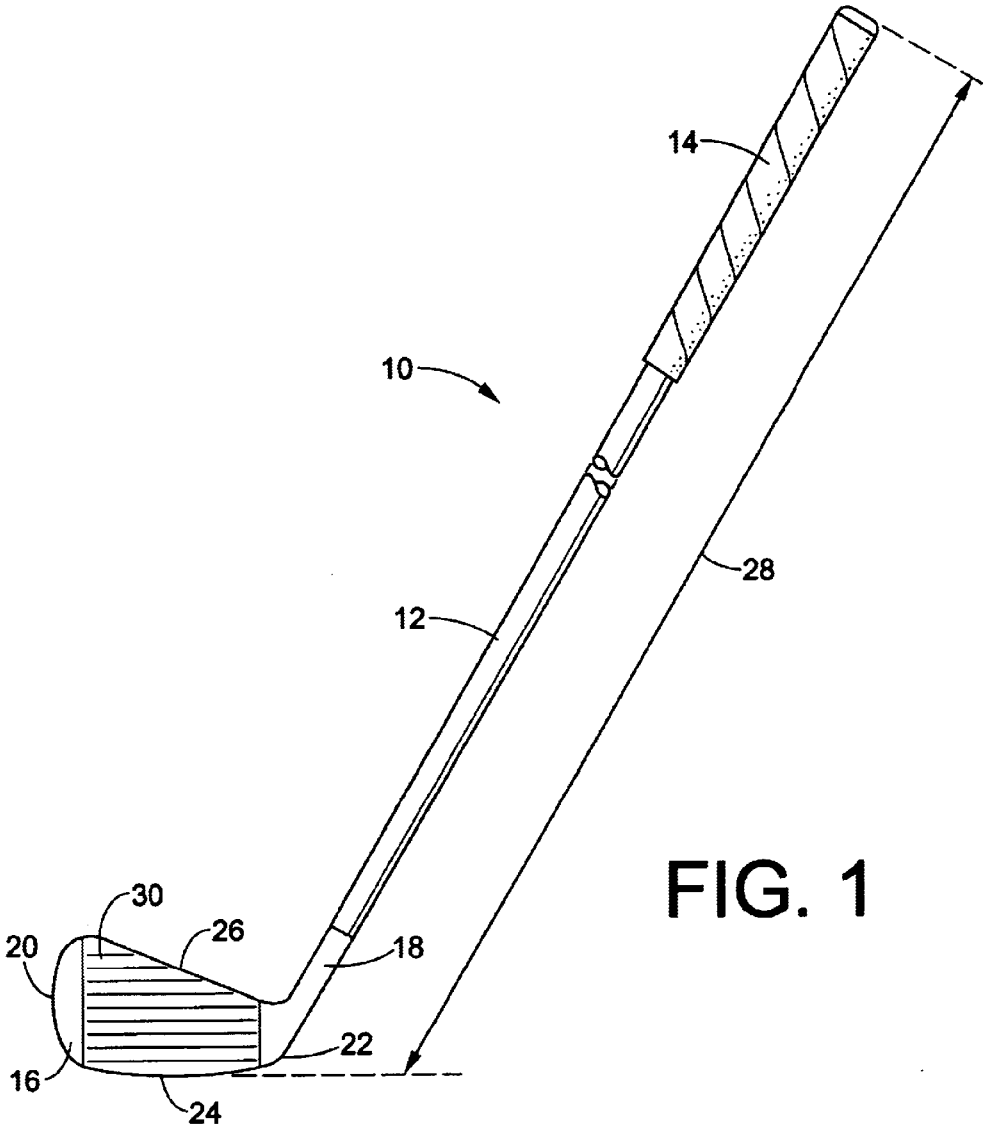
FIG. 1 is a front view of a golf iron in accordance with the present invention.

With reference to FIG. 1, a golf iron 10 includes a shaft 12 having a grip 14 and a club head 16. The club head 16 is connected by a hosel 18 to the shaft 12 in a conventional manner. Similarly, the grip 14 is attached to the shaft 12, as shown, in a conventional manner. The club head 16 includes a toe portion 20, a heel portion 22, a bottom or sole portion 24, and a top portion 26. The finished club height 28 progressively decreases from long irons, e.g., 1, 2, 3, and 4, to short irons, e.g., 8, 9, PW, and SW. A striking face 30, which contains a primary striking zone or sweet spot, is suitably scored with grooves.

Figure 2:
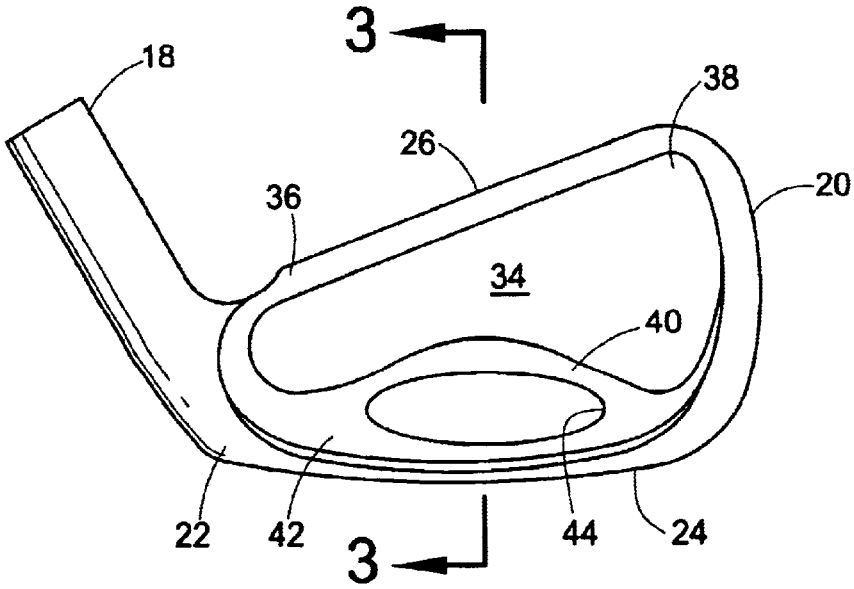
FIG. 2 is a rear view of the back of the iron club head in accordance with the present invention.

With reference to FIG. 2 and continuing reference to FIG. 1, a back view of the iron club head 16 is provided. A peripheral mass 36 is formed on the rear surface 34 of the iron club head 16, which defines a first cavity 38. Artisans will appreciate that cavity backed or perimeter weighted clubs enjoy a larger sweet spot or hitting area than conventional forged irons. As shown in FIG. 2, a cantilevered mass 40 extends from the sole portion 24 toward the top portion 26 within the first cavity 38. The cantilevered mass 40 includes a rear surface 42, which defines a second, preferably elliptical, cavity 44. However, as is described more fully below, the second cavity may be defined in a variety of other geometric configurations.

As is described more fully below, the height of the cantilevered mass 40 progressively increases in a set of irons from the long irons to the short irons. The location of the cantilevered mass 40 is below and behind the center or sweet spot of the striking face, which lowers the center of gravity of the club. This aids a golfer in placing the center of gravity of the club head below the center of the gravity of the golf ball at the moment of impact, which better produces a properly airborne and solidly hit golf shot having a high trajectory.

Figure 3:
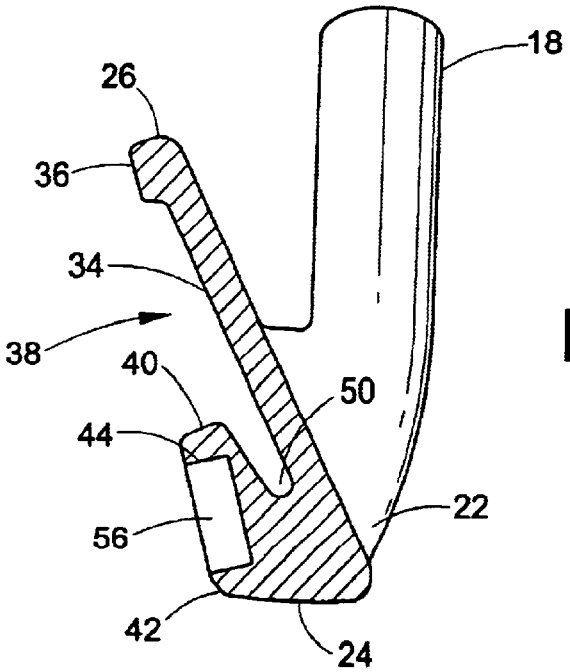
FIG. 3 is a cross-sectional view of the iron club head of FIG. 2 taken along the line 3—3 of FIG. 2.

As shown in FIG. 3 (cross-sectional view taken along line 3—3 from FIG. 2) at least a portion of the cantilevered mass 40 is optionally spaced apart from the rear surface 34 of the club head. In other words, the club head optionally includes an undercut channel 50. Preferably, the undercut channel 50 does not intersect the peripheral mass 36 near the heel or toe portions. It is to be appreciated that spacing the cantilevered mass 40 apart from the rear surface 34 provides additional forgiveness for off-center hits. In other words, golfers may still produce acceptable golf shots, despite striking the ball in a location on the striking face 30 other than the center or sweet spot. In one embodiment, the cantilevered mass 40 tapers from a thickness that is greatest near the sole portion 24 toward the top portion 26. As is described more fully below, the club head includes a weight medallion 56, which is disposed within the second cavity 44, as shown.

Figure 4A:
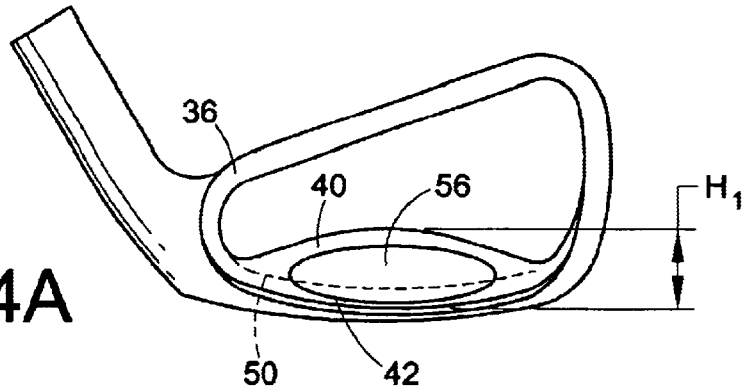
FIGS. 4A, 4B, and 4C are rear views of the back of the iron club head illustrating alternate embodiments for the cantilevered mass in accordance with the present invention.
Figure 4B:
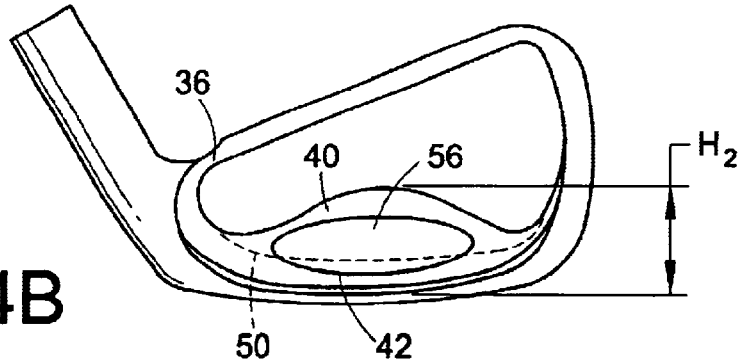
Figure 4C:
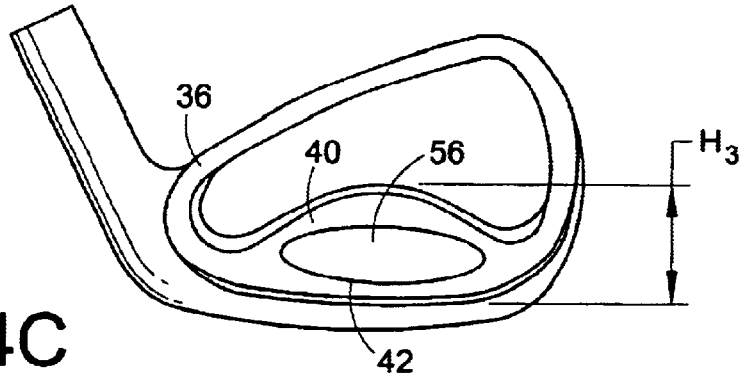

With reference now to FIGS. 4A, 4B, and 4C, in a full iron set, consisting of 1–9, PW and SW, the cantilevered mass 40 assumes one of three configurations, depending on whether it is present in a long iron, a middle iron, or a short iron. As shown, the cantilevered mass 40 is progressively lengthened from a low configuration having a height $H_1$ (FIG. 4A) for long irons (1–4), to a middle size having a height $H_2$ (FIG. 4B) for the middle irons (5–7), to a taller configuration having a height $H_3$ (FIG. 4C) for the short irons (8-SW). In one preferred embodiment, the cantilevered mass 40 and the peripheral mass 36 define an undercut channel for the long irons (FIG. 4A) and the middle irons (FIG. 4B). However, the undercut channel does not intersect the toe or heel portions of the peripheral mass.

It is to be appreciated that varying the height of the cantilevered mass, along with the presence of a progressive undercut channel, vertically adjusts the center of gravity for the golf club, and therefore, provides for an optimum trajectory and launch angle for each golf shot. In one embodiment, the cantilevered mass has a height $H_1$=0.810 inches for the long irons (FIG. 4A), a height of $H_2$=0.870 inches for the middle irons (FIG. 4B), and a height of $H_3$=0.920 inches for the short irons (FIG. 4C). However, other appropriate cantilevered mass heights are contemplated. By moving the center of gravity (CG) into a lower and back position for the long irons, higher shots are created and more stability is created on off-center shots, thereby increasing distance and accuracy. In the middle and short irons, the CG is moved up and toward the face slightly, thus eliminating any "ballooning" short iron shots, thereby providing enhanced trajectory and spin.

Figure 5A:
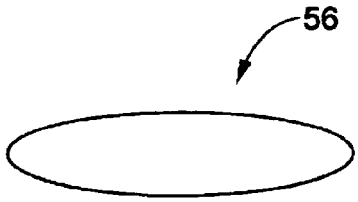
FIGS. 5A and 5B are top and side perspective views, respectively, of the weight medallion in accordance with one embodiment of the present invention.
Figure 5B:
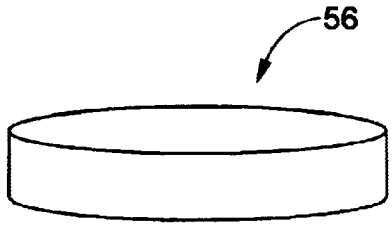
Figure 6:
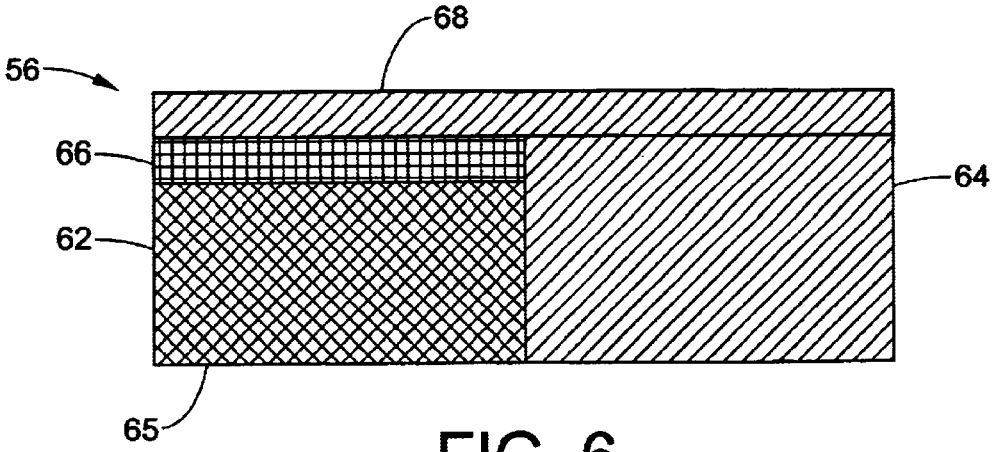
FIG. 6 is a cross-sectional view of a bi-material weight medallion in accordance with the present invention.
Figure 9A:
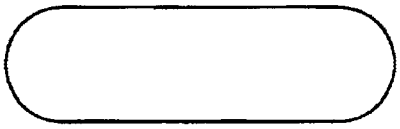
Figure 9B:
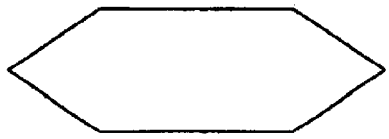
Figure 9C:
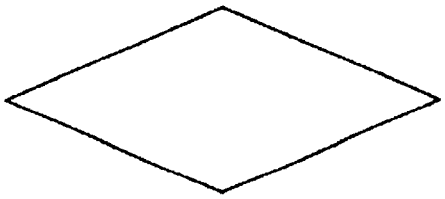
Figure 9D:
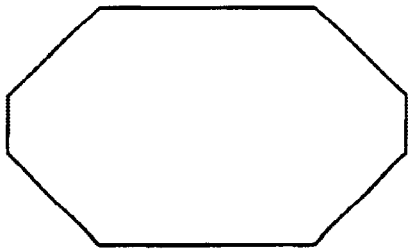
Figure 9E:
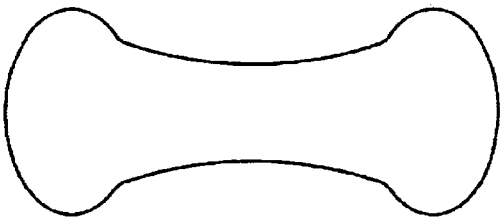

With reference to FIGS. 5A and 5B, the weight chip or medallion 56 is preferably elliptical in shape. However, it is to be appreciated that other horizontally elongated geometries, both symmetric and asymmetric, are contemplated. For example, as shown in FIGS. 9A–9E, the weight medallion may be an elongated oval (FIG. 9A), elongated hexagonal (FIG. 9B), elongated diamond-shaped (FIG. 9C), elongated octagonal (FIG. 9D), or another horizontally-elongated shape (FIG. 9E). In one embodiment, illustrated in FIG. 6, the weight medallion includes high-density semi-elliptical half 62 and a low-density semi-elliptical half 64. In this embodiment, a decorative medallion plate 68 of the same horizontally-elongated geometry is secured to the low-density half 64 which comprises an adhesive foam pad or other light-weight member, such as aluminum, on one side, and the high-density half 62 which comprises a tungsten chip. The tungsten chip is coated by first and second adhesive layers 65, 66, on the other side. In one embodiment, the overall weight medallion density is at least 1.0 g/cm$^3$, with the high-density tungsten semi-elliptical half comprising approximately 90% of the total mass of the weighted medallion. In one embodiment, the total weight of the medallion is 10 grams, however, it is to be appreciated that other suitable weights may be employed.

Figure 7:
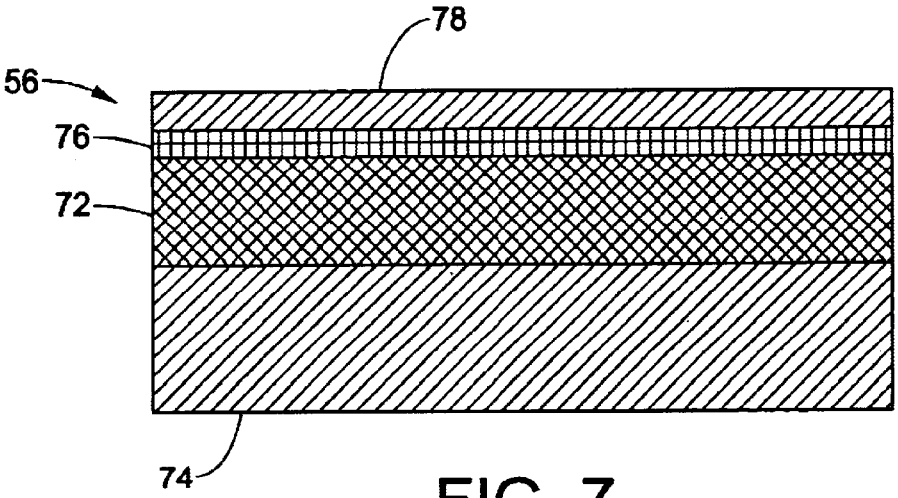
FIG. 7 is a cross-sectional view of a center-weighted medallion in accordance with the present invention.

It is to be appreciated that depending upon the orientation of the weight medallion within the second cavity, the horizontal center of gravity of the club may be adjusted to help control right or left shot tendencies experienced by a player. In an alternate embodiment, illustrated in FIG. 7, the weight medallion may be center-weighted or balanced. In this embodiment, the decorative medallion plate is adhesively secured to full elliptical or other horizontally-elongated tungsten chip 72 via an adhesive strip 76 or other suitable means. The underside of the tungsten chip 72 is adhesively secured to adhesive foam pad 74, as shown. While the center-weighted medallion does not shift the horizontal center of gravity, it aids in adjusting the overall center of gravity of the club to be lower and behind the geometric center of the striking face, providing longer and higher golf shots. In another alternate embodiment, the decorative medallion plate may be secured directly to an adhesive foam pad, providing center weighting and a lighter overall club head weight.

The bi-material weight medallion aids in providing a customizable golf club set, that is, a club set in which the weight medallion is used to horizontally adjust the center of gravity (heel to toe) to help control any right or left shot tendencies that a player may have. In one standard embodiment, the weight medallion is positioned such that the high-density or tungsten half is disposed adjacent the heel portion for long irons in order to off-set the tendency of the average golfer to push or fade long irons. Further, the tendency of many average golfers is to hit the middle irons relatively straight. Therefore, the middle irons are equipped with the center-weighted or balanced medallion (illustrated in FIG. 7). Because the tendency of many average golfers is to pull or hit short irons to the left, the bi-material medallion is positioned such that the high-density half is disposed adjacent the toe side, helping to hold the toe portion back and reducing the tendency to pull the shot left.

Figure 8:
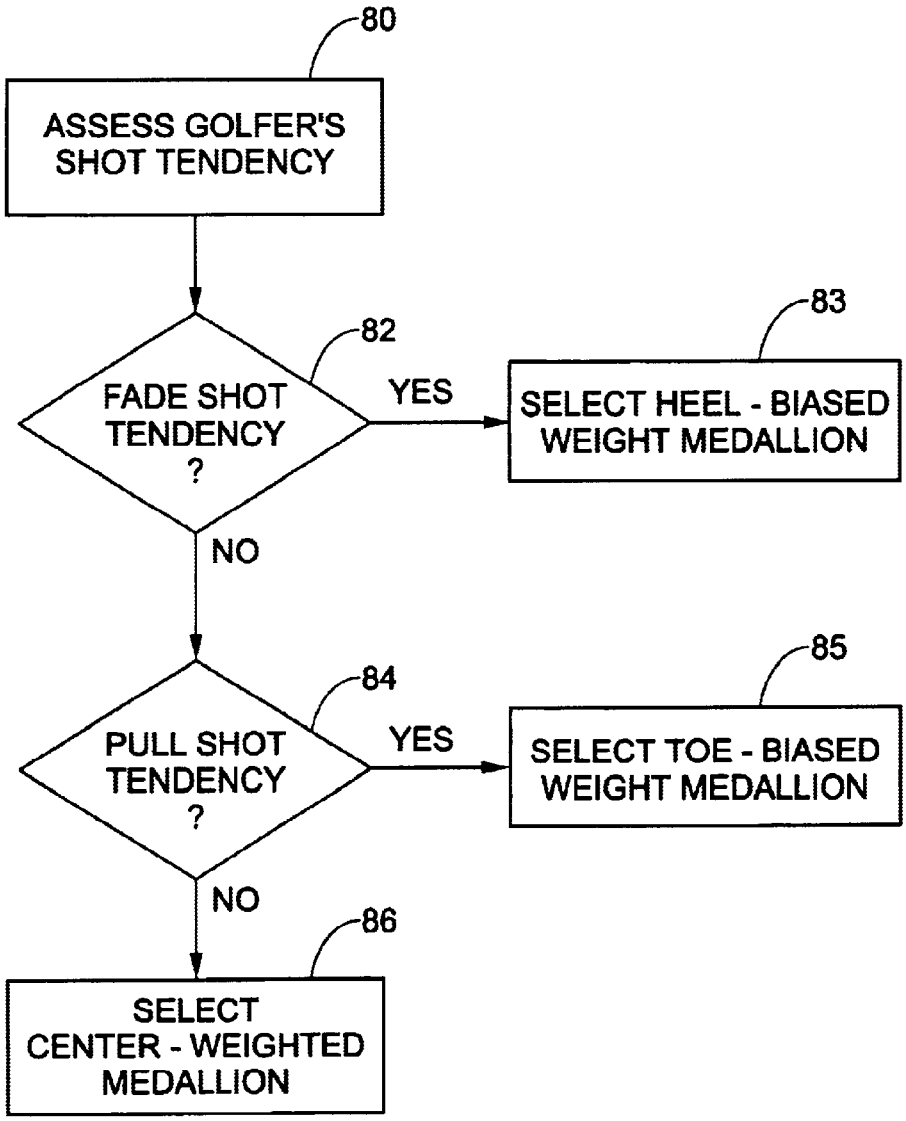
FIG. 8 is a flow chart illustrating a method of fitting a golfer with appropriate golf clubs in accordance with the present invention; and, FIGS. 9A–9E are top perspective views of alternate embodiments of the weight medallion in accordance with the present invention.

With particular reference to FIG. 8, the weighted medallion may be employed in a golf club fitting method, as shown. First, the shot tendency of the subject golfer is assessed 80 for each of the long irons, middle irons, and short irons. More particularly, for each club, it is determined whether the golfer's shot tendency is a fade 82. If the shot tendency is a fade, the heel-biased weight medallion configuration is selected 83. Additional weight placed towards the heel aids in holding the heel portion of the club head back, thus allowing the toe to pass through the shot faster, squaring the blade to hit straighter shots and reducing the potential to hit a shot to the right. If it is determined that, for a given club, the player's shot tendency is to pull or hit the ball left 84, the toe-biased weight medallion is selected 85. It is to be appreciated that extra weight placed towards the toe aids in holding the toe section back, thus reducing the tendency to pull shots to the left. If it is determined that, for a given club, the player's shot tendency is straight, the center-weighted or balanced weight medallion 86 is selected.

It is to be appreciated that the weight medallion in conjunction with the above-identified method provides for a plurality of player tendency custom set options. For example, a highly skilled player, such as a tour professional, typically does not struggle with pushing or pulling shots. Therefore, most tour professionals would be fit with a set of irons in which each iron employs the center-weighted medallion of either all tungsten or all light-weight material, depending upon desired swing weight. Alternately, a player may have a tendency to draw or pull shots with all of the irons, long, middle, and short. For such a player, the toe-biased weight medallion would be employed to facilitate greater accuracy and control.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof

Having thus described the preferred embodiment, the invention is now claimed to be:

1. A golf iron set including a plurality of long irons, middle irons, and short irons, each of said irons having a club head comprising:

a heel portion, a toe portion, a sole portion, a top portion, a hosel portion, a striking face having a front surface and a back surface, a peripheral mass disposed on the back surface, said peripheral mass defining a first cavity;

a first weight member extending from the sole portion toward the top portion within the first cavity, said first weight member having a rear surface which defines a second cavity;

a weight medallion disposed within the second cavity;

wherein for the long irons said first weight member has a height $H_1$;

wherein for the middle irons said first weight member has a height $H_2$, where $H_2>H_1$; and wherein for the long irons at least a portion of the first weight member is spaced apart from the back surface.

2. The golf iron set according to claim 1, wherein for the short irons the first weight member has a height $H_3$, where $H_3>H_2$.

3. The golf iron set according to claim 2, wherein for short irons said weight medallion includes a high-density portion disposed toward the toe portion and a low-density portion disposed toward the heel portion.

4. The golf iron set according to claim 1, wherein for the middle irons at least a portion of the first weight member is spaced apart from the back surface.

5. The golf iron set according claim 1, wherein for middle irons said weight medallion includes two halves of equal density.

6. A set of golf irons including a first club having a first loft angle and a second club having a second loft angle less than the first angle, wherein each of said first club and said second club includes a heel portion, a toe portion, a sole portion, a top portion, a hosel portion, a striking face having a front surface and a back surface, a peripheral mass disposed on the back surface, said peripheral mass defining a first cavity, and a first weight member extending from the sole portion toward the top portion within the first cavity, the first weight member having a rear surface that defines a second cavity, wherein the first weight member of said first club extends from the sole portion a height $H_1$ and the first weight member of said second club extends from the sole portion a height $H_2$, where $H_2>H_1$ and wherein at least a portion of the first weight member of at least one of said first club and said second club is spaced apart from the back surface.

7. The set of claim 6, wherein at least one of said first club and said second club includes a means for horizontally adjusting the center of gravity of the club disposed within the second cavity.

8. The set of claim 7, wherein the means for horizontally adjusting the center of gravity of the club in at least one said first club and said second club comprises a weight medallion including a high-density portion and a low-density portion.

9. The set of claim 8, wherein the high-density portion of the weight medallion of said second club is disposed adjacent the heel portion.

10. The set of claim 8, wherein the low-density portion of the weight medallion of said first club is disposed adjacent the heel portion.

11. A method of making a golf iron to fit a player's golf swing, the method comprising:

making a golf iron including a heel portion, a toe portion, a sole portion, a top portion, a hosel portion, a striking face having a front surface and a back surface, a peripheral mass disposed on the back surface, said peripheral mass defining a first cavity, a first weight member extending from the sole portion toward the top portion within the first cavity and having at least a portion spaced from the back surface, the first weight member having a rear surface which defines a second cavity, and said golf iron having a predetermined loft angle;

adjusting the center of gravity of said iron in a vertical direction in response to the loft angle by extending the first weight member from the sole portion a predetermined height; and providing a means for adjusting the center of gravity of said iron in a horizontal direction disposed within the second cavity.

12. The method of claim 11, wherein for a golf iron having a loft angle of about 17° to 25° adjusting the center of gravity in a vertical direction comprises extending the first weight member from the sole portion a height equal to or less than about 0.810 inches.

13. The method of claim 11, wherein for a golf iron having a loft angle of about 26° to 39° adjusting the center of gravity in a vertical direction comprises extending the first weight member from the sole portion a height about 0.810 to 0.920 inches.

14. The method of claim 11, wherein for a golf iron having a loft angle of about 40° to 60° adjusting the center of gravity in a vertical direction comprises extending the first weight member from the sole portion a height equal to or greater than about 0.920 inches.

15. A method of making a golf iron to fit a players golf swing, the method comprising:

making a golf iron including a heel portion, a toe portion, a sole portion, a top portion, a hosel portion, a striking face having a front surface and a back surface, a peripheral mass disposed on the back surface, said peripheral mass defining a first cavity, a first weight member extending from the sole portion toward the top portion within the first cavity and having at least a portion spaced from the back surface, the first weight member having a rear surface which defines a second cavity, and said golf iron having a predetermined loft angle;

adjusting the center of gravity of said iron in a vertical direction in response to the loft angle; and providing a means for adjusting the center of gravity of said iron in a horizontal direction disposed within the second cavity, the means comprises disposing a weight medallion within the second cavity, wherein the weight medallion includes a first portion having a first density and a second portion having a second density, wherein the first density is greater than the second density.

16. The method of claim 15, further comprising adjusting the center of gravity of said iron in a horizontal direction.

17. The method of claim 16, wherein for a golf iron having a loft angle of about 17° to 25°, adjusting the center of gravity in a horizontal direction comprises positioning the first portion of the weight medallion adjacent the heel.

18. The method of claim 16, wherein for a golf iron having a loft angle of about 40° to 60°, adjusting the center of gravity in a horizontal direction comprises positioning the first portion of the weight medallion adjacent the toe.

19. The method of claim 16, Wherein adjusting the center of gravity in a vertical direction comprises extending the first weight member from the sole portion a predetermined height.

20. A golf iron set including a plurality of long irons, middle irons, and short irons, each of said irons having a club head comprising:

a heel portion, a toe portion, a sole portion, a top portion, a hosel portion, a striking face having a front surface and a back surface, a peripheral mass disposed on the back surface, said peripheral mass defining a first cavity;

a first weight member extending from the sole portion toward the top portion within the first cavity, said first weight member having a rear surface which defines a second cavity;

a weight medallion disposed within the second cavity;

wherein for the long irons said first weight member has a height $H_1$;

wherein for the middle irons said first weight member has a height $H_2$, where $H_2>H_1$; and wherein for the middle irons at least a portion of the first weight member is spaced apart from the back surface.

* * * * *